US011142390B1

(12) United States Patent
Freudenberg et al.

(10) Patent No.: US 11,142,390 B1
(45) Date of Patent: Oct. 12, 2021

(54) AEROSOL ACTUATOR

(71) Applicant: WD-40 MANUFACTURING COMPANY, San Diego, CA (US)

(72) Inventors: John W. Freudenberg, Marysville, OH (US); Joseph G. Peschke, Crystal Lake, IL (US); Paul Mierzwa, Dixon, IL (US); Michael J. Starzman, Jackson, WI (US); Ryan Paul Davidson, Madison, WI (US); Christopher Michael Howell, Poway, CA (US)

(73) Assignee: WD-40 MANUFACTURING COMPANY, San Diego, CA (US)

( * ) Notice: Subject to any disclaimer, the term of this patent is extended or adjusted under 35 U.S.C. 154(b) by 0 days.

(21) Appl. No.: 16/904,892

(22) Filed: Jun. 18, 2020

(51) Int. Cl.
*B65D 83/20* (2006.01)
*B65D 83/28* (2006.01)

(52) U.S. Cl.
CPC ..... *B65D 83/205* (2013.01); *B65D 83/28* (2013.01)

(58) Field of Classification Search
CPC .. B65D 83/201; B65D 83/202; B65D 83/205; B65D 83/206; B65D 83/207; B65D 83/28; B65D 83/228; B65D 83/40
USPC ..... 239/600; 222/402.13, 541.1–541.9
See application file for complete search history.

(56) References Cited

U.S. PATENT DOCUMENTS 3,169,672 A * 2/1965 Soffer ..... B65D 83/205 222/153.11
3,269,614 A * 8/1966 Abplanalp ..... B65D 83/205 222/402.13
3,281,021 A * 10/1966 Seaquist ..... B65D 83/205 222/182
3,286,885 A * 11/1966 Huling ..... B65D 83/205 222/182
3,377,005 A * 4/1968 Marder ..... B65D 83/40 222/402.13
3,519,173 A * 7/1970 Sagarin ..... B65D 83/24 222/402.13
3,578,220 A * 5/1971 Green ..... B65D 83/205 222/402.13
3,651,993 A * 3/1972 Venus, Jr. ..... B65D 83/22 222/153.02
3,661,300 A * 5/1972 Nigro ..... B65D 83/228 222/80
3,770,167 A * 11/1973 Ewald ..... B65D 83/20 222/153.11

(Continued)

*Primary Examiner* — Vishal Pancholi
*Assistant Examiner* — Bob Zadeh
(74) *Attorney, Agent, or Firm* — Epstein Drangel LLP; Robert L. Epstein

(57) ABSTRACT

The aerosol actuator includes a shroud. An actuation member situated within the shroud has a stem bore pocket adapted to receive the valve stem of the aerosol container. In high speed production, entrance of the stem into the pocket as the shroud is mounted on the aerosol container is facilitated by providing the pocket with a plurality of inwardly extending compressible ribs and a tab extending from the shroud which stabilizes the actuation member within the shroud. The tab is pivoted out of the path of movement of the actuation member upon initial depression of the actuation member by the user. To prevent accidental depression of the actuation member by a top load, the shroud wall is extended above the plane of the surface of the actuation member.

8 Claims, 9 Drawing Sheets

(56) References Cited

U.S. PATENT DOCUMENTS 3,913,805 A * 10/1975 Sette ..... B65D 83/205 222/402.11
4,095,725 A * 6/1978 Goncalves ..... B65D 83/228 222/153.06
4,424,920 A * 1/1984 Tada ..... B65D 83/205 222/153.07
5,203,478 A * 4/1993 de Laforcade ..... B65D 83/206 222/402.13
5,332,157 A * 7/1994 Proctor ..... B05B 11/0064 239/304
5,388,730 A * 2/1995 Abbott ..... B65D 83/205 222/153.13
5,588,566 A * 12/1996 de Laforcade ..... B65D 83/205 222/402.11
5,649,645 A * 7/1997 Demarest ..... B65D 83/205 222/153.07
5,899,623 A * 5/1999 de Laforcade ..... A45D 34/041 222/402.13
6,454,139 B1 * 9/2002 Bayer ..... B65D 83/206 222/183
6,971,560 B1 * 12/2005 Healy ..... B65D 83/206 222/402.13
7,137,536 B2 * 11/2006 Walters ..... B65D 83/206 222/402.11
8,276,832 B2 * 10/2012 Nelson ..... B65D 83/206 239/391
8,499,984 B2 * 8/2013 Strand ..... B05B 11/3057 222/402.13
8,622,256 B2 * 1/2014 Campbell ..... B65D 83/205 222/402.11
8,881,944 B2 * 11/2014 Paas ..... B65D 83/22 222/1
9,022,301 B2 * 5/2015 Sell ..... B65D 83/201 239/337
2003/0106901 A1 * 6/2003 Meshberg ..... B05B 11/3077 222/1
2003/0127468 A1 * 7/2003 Loghman-Adham ..... B65D 83/205 222/153.14
2003/0213817 A1 * 11/2003 Meshberg ..... B05B 11/3077 222/402.1
2005/0211733 A1 * 9/2005 Healy ..... B65D 83/206 222/402.1
2005/0218164 A1 * 10/2005 Morris ..... B65D 83/228 222/402.13
2006/0219823 A1 * 10/2006 Eberhardt ..... B65D 83/206 239/590
2007/0164056 A1 * 7/2007 Eberhardt ..... B65D 83/46 222/402.13
2013/0228593 A1 * 9/2013 Adams ..... B65D 83/205 222/402.13
2015/0090736 A1 * 4/2015 Erickson ..... B65D 83/206 222/153.1

* cited by examiner

AEROSOL ACTUATOR

BACKGROUND OF THE INVENTION

1. Field of the Invention

The present invention relates to actuators for pressurized aerosol containers of the type having a spring-loaded valve stem and more particularly to an actuation member which allows a "wobbly" actuation member to be mounted on a container in high speed production due to a unique stem bore pocket design including internal ribs which maintains alignment between the bore pocket and the valve stem such that the necessary seal is created, to a tab which stabilizes the actuation member as the valve stem is inserted into the bore pocket and to a shroud with an extended wall which eliminates accidental depression of the actuation member resulting from an external top load force.

2. Description of Prior Art Including Information Disclosed Under 37 CFR 1.97 and 1.98

Actuators for pressurized fluid containers with depressible spring-loaded valve stems are well-known in the art. The actuators are designed to be mounted on the top of the container, over the vertically extending valve stem. The actuator includes an actuation member which aligns with and engages the valve stem. The actuation member is moveably mounted within a shroud designed to engage the top of the container. When an external, downwardly directed force is applied to the actuation member, the member is moved toward the container to depress the valve stem to release the contents of the container. The actuation member includes nozzle connected to the valve stem to direct the fluid exiting the container.

When actuators are mounted on pressurized containers by hand or on low speed production lines, it is relatively easy to correctly align the actuator with the container such that the valve stem can be seated in the stem bore pocket at the bottom of the actuation member. However, on a high-speed production line, such as a production line running at 300 pieces per minute, problems are encountered with regard to the proper alignment and stabilization of the actuation member as the valve stems are received in the actuation member pocket unless the bore pocket is designed to be spaced from the valve stem within the bore pocket such that no seal between the bore pocket and the valve stem is required until the user depresses the actuation member or the bore pocket is designed to always be connected to the valve stem and never separated from the stem to break the seal. Otherwise, in practice, high speed assembly of actuators on containers has proven difficult to achieve.

Various designs have been considered to overcome this problem. A floating pocket was unsuccessful because of the production height of the stems as well as the molding and assembly tolerances which exceed the sealing parameters. A longer bore pocket provided inconsistent release during re-engagement. A mid-range length bore pocket with a high seal and reduced vertical radial seal depth was partially successful, but the actuation member prior to engagement with the valve stem was too "wobbly" to provide consistent alignment.

Those issues are overcome in the present invention by creating a "sliding seal" which allows the valve stem to move within the bore pocket to disengage and re-engage the valve stem. This is possible through the use of internal "ribs" proximate the bore pocket entrance. The ribs engage the stem just below the radial seal area to facilitate entrance of the stem into the pocket without excessive drag that would cause the stem to stick in the pocket.

The ribs are formed of material which is somewhat resilient or compressible which can be "crushed" to a small extent by the stem as the stem enters the pocket. The portion of the surface of the ribs proximate the pocket entrance is also inclined to provide the necessary lead in angle to funnel the stem into the pocket to allow high speed application that functions within the machine locating tolerances such that the production equipment can run at a targeted 300 pieces per minute.

The rib design with the higher internal seal also eliminates the need to "hammer" the pocket onto the stem, preventing accidental release of the container contents and allowing for higher application run speeds.

The ribs protrude from the interior surface of the stem bore pocket and extend in a direction generally parallel to the central axis of the pocket. At least five ribs circumferentially placed within the pocket are preferred to ensure consistent self-centering of the stem within the pocket.

The bore pocket with the internal ribs is primarily intended for use in situations where other components of the actuator serve to stabilize the actuation member such that the seal and re-seal between the bore pocket and valve stem can occur without wobble. In those situations, a component of the actuator may be provided to stabilize the actuation member prior to the actuator being mounted on the container during high speed production.

For proper stabilization of the actuation member within the shroud as the actuators are mounted, it is necessary that the stem bore pocket of the actuation member be consistently located above and attached to the valve stem. To achieve that, the present invention employs a stabilizing tab to ensure that the actuation member is always in the correct position relative to the shroud such that the valve stem can be received in the pocket.

The stabilizing tab is molded as part of the shroud and extends from the shroud wall toward the stem bore pocket of the actuation member to position the stem bore pocket during production. The stabilizing tab holds the actuaton member steady with the required force to ensure that the stem bore pocket remains within the necessary range for effective and consistent application of the actuator at production speeds up to 300 pieces per minute.

The stabilizing tab remains in place in the actuator until the first use of the actuator. The actuation member is provided with a part which engages and pivots the tab out of the path of the actuation member as the actuation member is depressed the first time by the user. The required force to move the tab, while depressing the valve, is well within the anthropometric force to actuate even when compounded with the force to open the valve. The depression force would be considered to be normal consumer use for dispensing an aerosol product.

Another issue encounter by actuators of this type relates to accidental discharge of the container contents during shipping and storage due to various types of external force causing top load pressure on the actuation member. In the present invention, structure is provided to protect the actuation member from depression by planar objects, such as other aerosol containers stacked on top of the aerosol container, without additional packaging materials and without restricting access to the actuation member during use.

The actuation member is protected by extending the height of the shroud wall, within which the actuation member is situated, such the top of the shroud wall is situated in a plane which is slightly higher than the plane of the actuation member.

The extended shroud allows a top load pressure to make contact with the shroud and transfer the force down through the shroud wall and into the valve cup and container. This keeps the actuator from accidentally discharging during shipping and storage with no additional inner packaging. The easy access to the actuation member is maintained for consumer ease of use.

BRIEF SUMMARY OF THE INVENTION

To those, and other objects which may appear, the present invention relates to an aerosol actuator for use with a container of pressurized fluid of the type having a valve with a stem depressible to release the contents of the container. The actuator includes a shroud adapted to be situated on the container over the stem. The shroud has a wall defining a space within which an actuation member is situated. The actuation member includes a stem bore pocket adapted to receive the valve stem. The actuation member is mounted within the shroud for movement relative to the shroud between a first position wherein the valve stem is not depressed and a second position wherein the valve stem is depressed to release the contents of the container. The actuation member has a nozzle with a channel connecting the valve stem and the outlet port of the nozzle. The stem bore pocket has an axis and an interior surface. A plurality of ribs extending inwardly from the interior surface of the stem bore pocket along the direction of the stem bore pocket axis to facilitate entrance of the valve stem into the stem bore pocket.

The ribs are circumferentially around the interior surface of the stem bore pocket.

At least five ribs are provided. The ribs engage the stem at a position spaced from or just below the radial seal area.

The ribs are formed of compressible material.

The ribs are provided with inclined surface portions proximate the stem bore pocket entrance.

The actuator also includes a tab extending from the shroud toward the actuation member. The tab functions to position and stabilize the actuation member such that the stem bore pocket is correctly positioned relative to the valve stem as the actuator is situated on the container.

In accordance with another aspect of the present invention, an aerosol actuator is provided for use with a container of pressurized fluid of the type having a valve with a stem depressible to release the contents of the container. The actuator includes a shroud adapted to be situated on the container over the stem. The shroud defines a space within which an actuation member is situated. The actuation member is mounted within the shroud for movement relative to the shroud between a first position wherein the valve stem is not depressed and a second position wherein the valve stem is depressed to release the contents of the container. The actuation member includes a nozzle with a channel connecting the valve stem and the outlet port of the nozzle. A tab extending from the shroud to the actuation member is provided to position the actuation member relative to the shroud.

The actuation member includes a stem bore pocket. The tab positions the stem bore pocket relative to the valve stem and stabilizes the actuation member during assembly of the actuator and the container.

The actuator additionally includes a part adapted to engage and pivot the tab out of the path of the movement of the actuation member as the actuation member is depressed.

The tab is connected to the shroud by a living hinge. The actuation member part has an edge which contacts the tab at a location proximate the living hinge.

In accordance with another aspect of the present invention, an aerosol actuator for use with a container of pressurized fluid of the type having a valve with a stem depressible to release the contents of the container is provided. the actuator includes a shroud adapted to be situated on the container over the stem. The shroud includes wall which defines a space and has a top edge. An actuation member is aligned with the valve stem. The actuation member has a surface and is mounted within the shroud space for movement relative to the shroud between a first position wherein the valve stem is not depressed and a second position wherein force is applied to the actuation member to depress the valve stem and release the contents of the container. The actuation member includes a nozzle and a channel connecting the valve stem and the outlet port of the nozzle. The plane of the actuation member surface is situated below the top edge of the shroud wall to protect the actuation member from accidental depression by a top load.

BRIEF DESCRIPTION OF THE SEVERAL VIEWS OF DRAWINGS

To these and to such other objects that may hereinafter appear, the present invention relates to an aerosol actuator for a pressurized fluid container as described in detail in the following specification and recited in the annexed claims, taken together with the accompanying drawings, in which like numerals refer to like parts and in which:

DETAILED DESCRIPTION OF THE INVENTION

Figure 1:
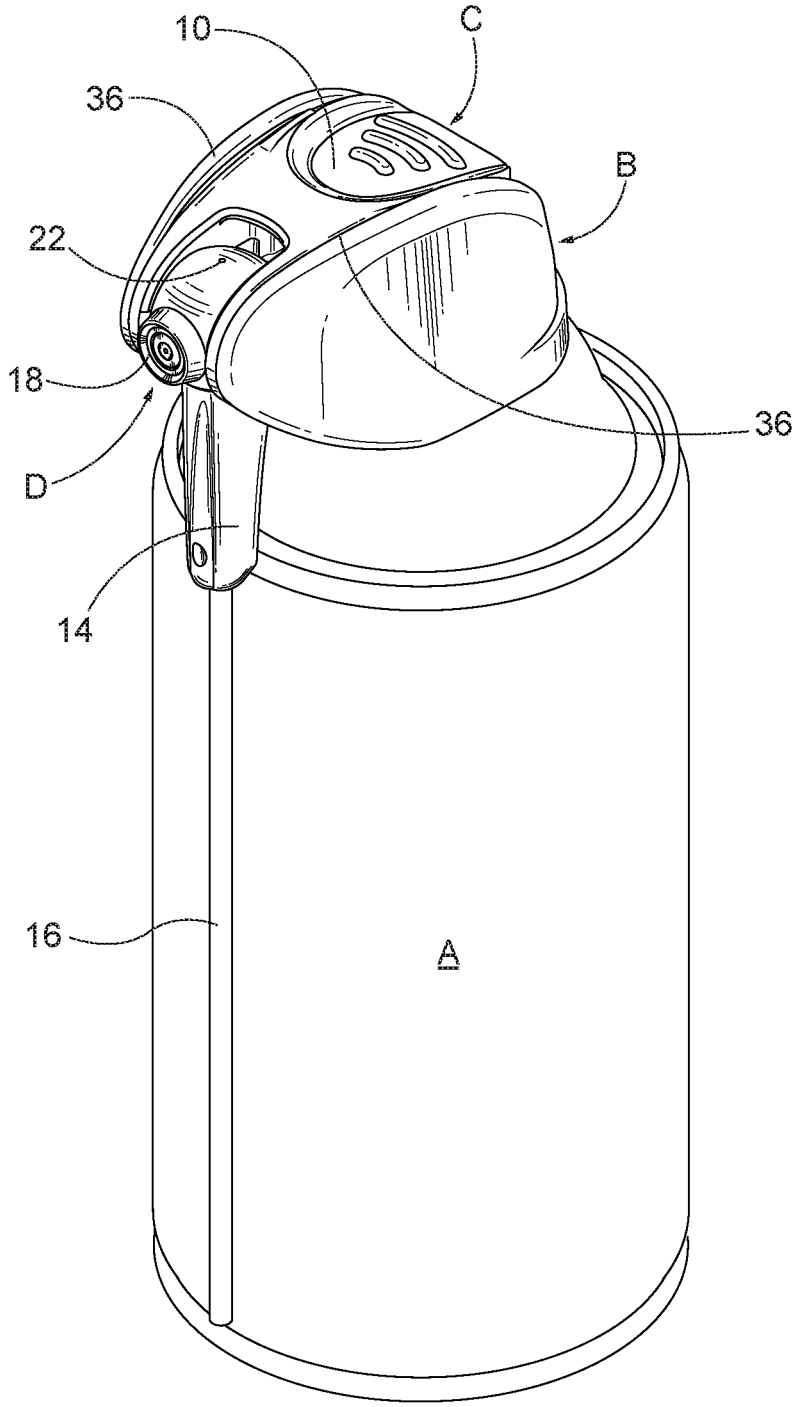
FIG. 1 is a perspective view of the aerosol actuator of the present invention as it would appear mounted on a pressurized container.

FIGS. 1-4 show the exterior of the aerosol actuator of the present invention. FIG. 1 shows the actuator as it would appear on a pressurized fluid container, generally designated A. As is conventional, a spring-loaded valve stem protrudes from the center of the top of the container (not visible in these figures) which when depressed releases the pressurized fluid in the container.

The actuator is formed of three basic parts: a shroud, generally designated B, adapted to be mounted on the top of container A, over the valve stem; an actuation member, generally designated C, which is moveably mounted within shroud B in order to depress the valve stem; and a nozzle, generally designated D, including a fluid channel extending from the valve stem to the outlet port of the nozzle (not visible in these figures). Nozzle D is moveably mounted to actuation member C and can be rotated between vertical and horizontal positions to provide different spray patterns.

Shroud B includes a generally "U" shaped wall defining an opening within which actuation member C is received. The bottom of the shroud wall is configured to engage the top of container A to mount the actuator on the container.

The top of actuation member C includes a button with a surface 10 defining an area where the finger of the user may be positioned to apply an external downwardly directed force to move the actuation member to depress the valve stem in order to release the pressurized fluid in the container. Surface 10 may be provided with spaced parallel protrusions to provide a non-slip surface for the finger of the user.

Figure 8:
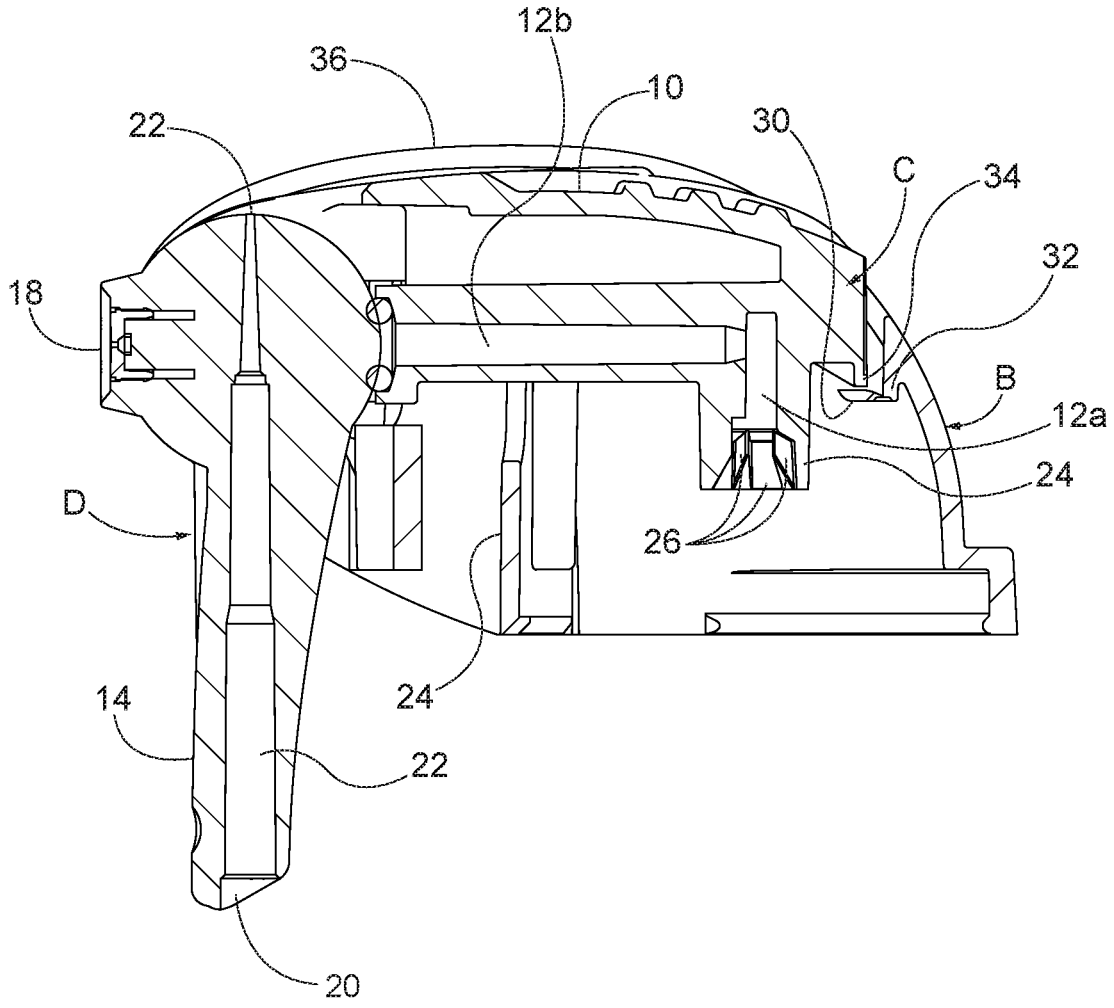
FIG. 8 is a cross-sectional view of the actuator.

As best seen in FIG. 8, the actuation member has an internal channel 12 connecting the valve stem to the nozzle. Channel 12 has a vertical portion 12*a*, aligned with the valve stem and a horizontal portion 12*b* leading to the nozzle. Depression of the valve stem releases the contents of the container into channel portion 12*a*. From channel portion 12*a*, the released fluid is conducted through channel portion 12*b* to the nozzle.

Nozzle D is rotatably mounted between the walls of the shroud between the position illustrated in FIG. 1, where the elongated portion 14 of the nozzle and the straw 16 extending from portion 14 are in the vertical position, and a position (not shown) where the elongated portion 14 of the nozzle and the straw 16 are in the horizontal position.

Nozzle D has two spray outlet ports 18 and 20. In the position illustrated in FIG. 1, outlet port 18 is connected to the end of channel portion 12*b* through the body of the nozzle and will provide a wide-angle spray pattern of the fluid released from the container. When the nozzle is rotated to the position where the nozzle portion 14 is horizontal, the end of channel portion 12*b* is aligned with opening 22 which will conduct the released fluid through port 20 to the straw 16. The fluid exits the straw in a concentrated spray pattern.

Figure 5:
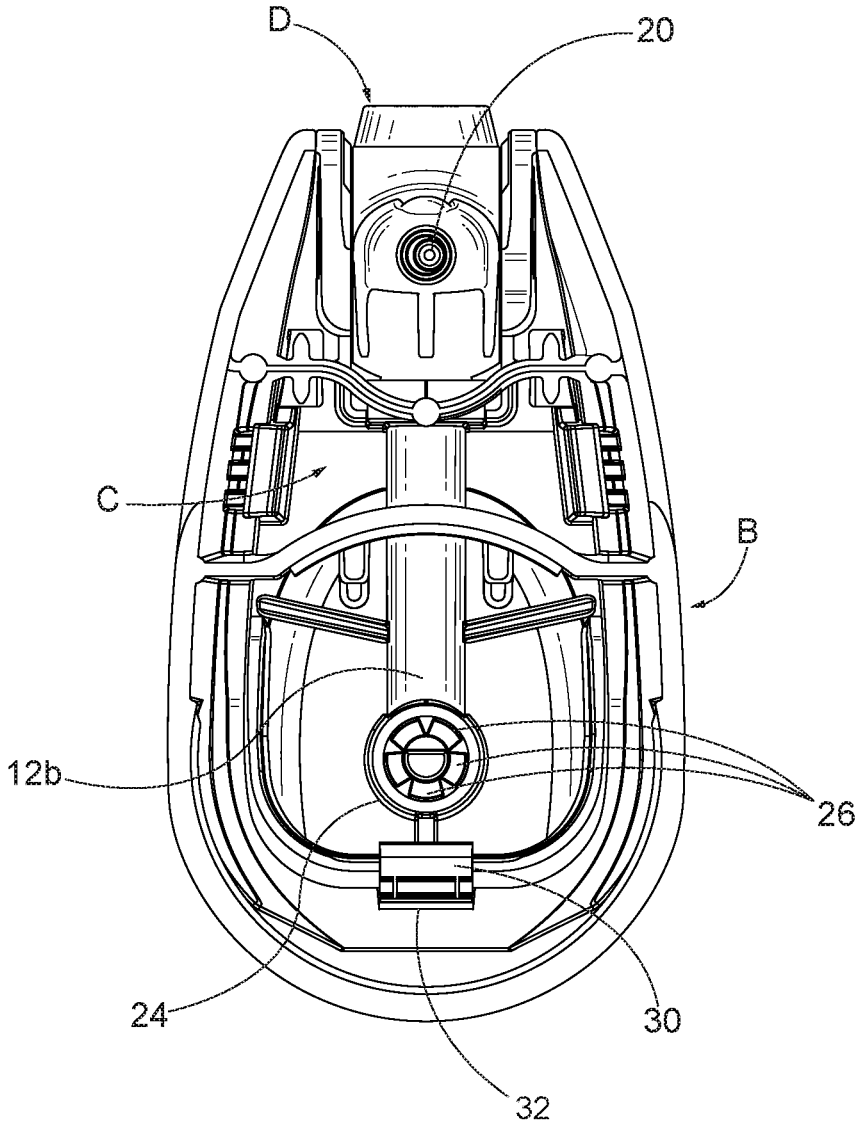
FIG. 5 is a plan view of the bottom of the actuator.
Figure 6:
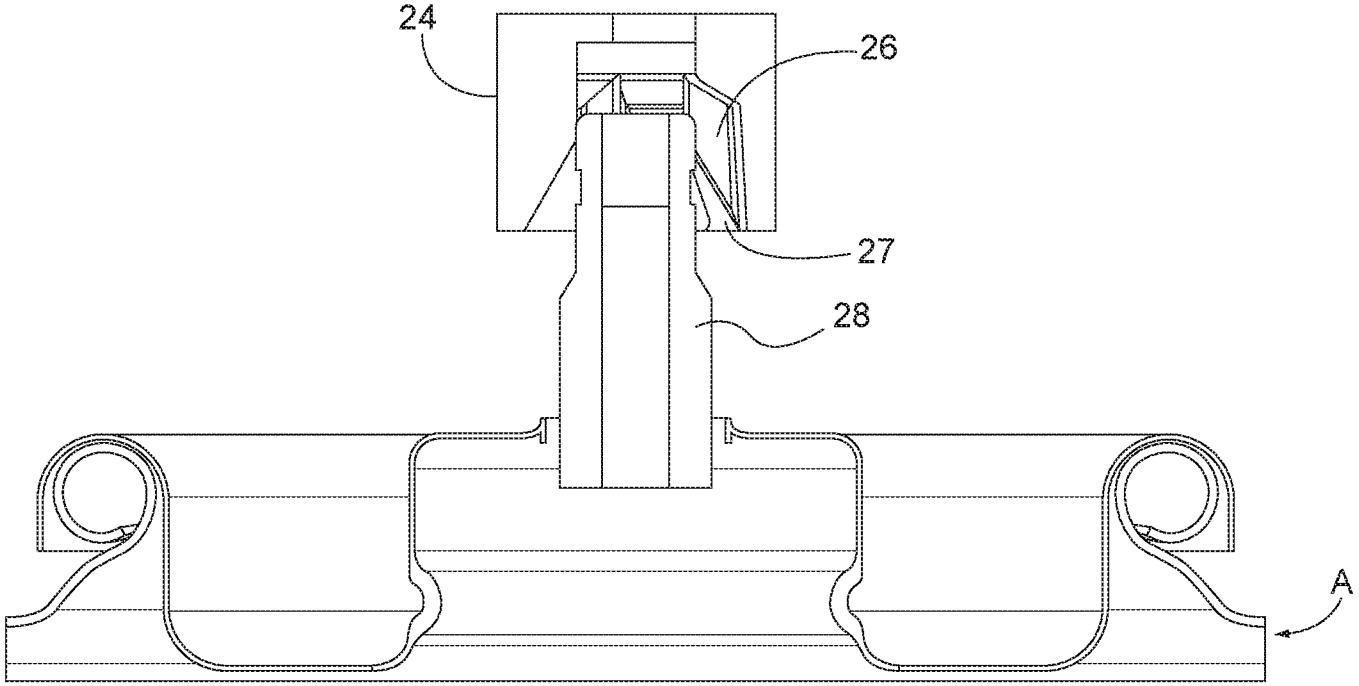
FIG. 6 is an enlarged cross-sectional view of the top of the container, the valve stem and stem bore pocket.

Referring now to FIGS. 5 through 8, the inlet end of channel 12*a* is provided with a stem bore pocket 24. Pocket 24 is adapted to receive the end of the valve stem 28 when the actuator is mounted on the container, as seen in FIG. 6.

The inlet end of pocket 24 is provided with a plurality of ribs 26 with protrude from the interior surface of the bore and extend along the internal surface of the bore in a direction substantially parallel to the axis of the bore. The ribs are formed of resilient or compressible material and have tapered outer edges 27 as is best seen in FIG. 6. The ribs guide the end of the valve stem 28 into the pocket by aligning the pocket with the valve stem as the actuator is mounted on the container. This configuration allows actuators to be positioned or aligned with the valve stem prior to a seal being achieved and therefore not requiring the valve to be depressed and or activated so that the actuator can be mounted on containers at higher speed than would not otherwise be possible.

Figure 7:
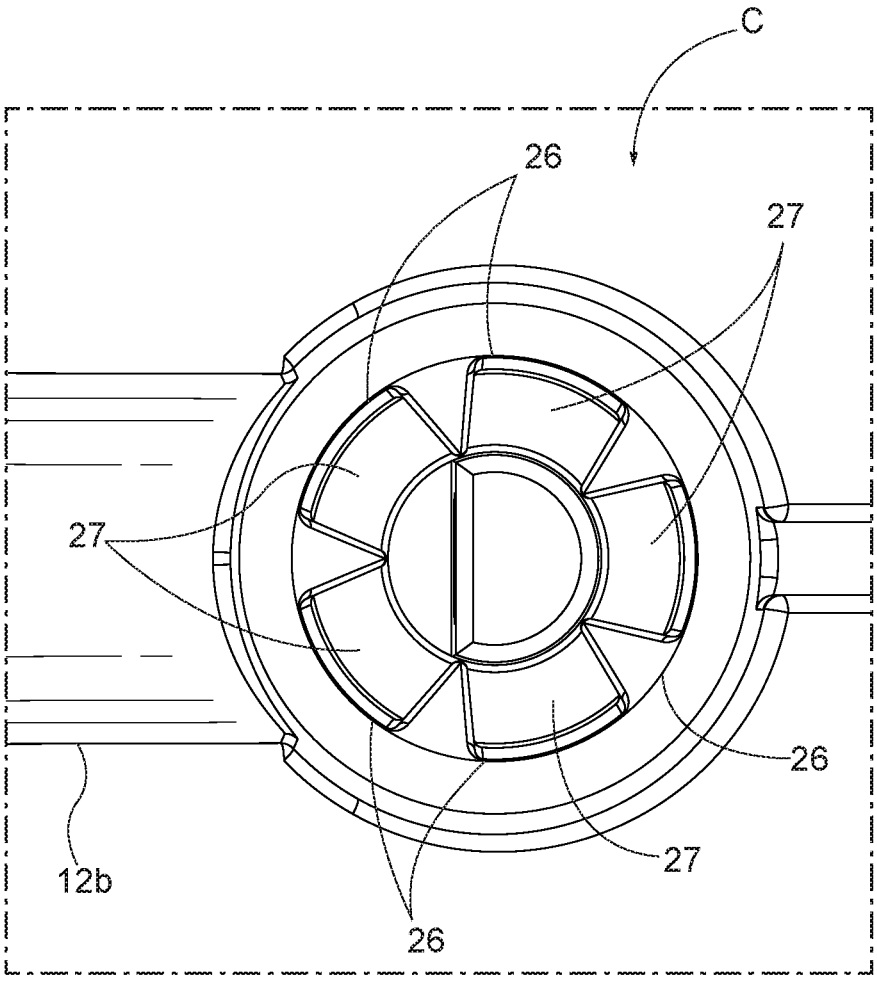
FIG. 7 is an enlarged view of a stem bore pocket.

Ribs 26 are circumferentially arranged around the interior surface of the stem bore pocket. The ribs flare out as they extend toward the bore opening such that tapered outer edges 27 are spaced apart as best seen in FIG. 7. This configuration acts to funnel the valve stem into the pocket, correcting any misalignment which may exist between the actuation member and the valve stem as the actuators are mounted on the containers. Preferably, the ribs are designed to engage the stem at a point spaced from the radial seal area, at a position just below the radial seal area.

The number of the ribs may differ. The figures illustrate the pocket with five ribs. However, different numbers of ribs may be used.

Figure 9:
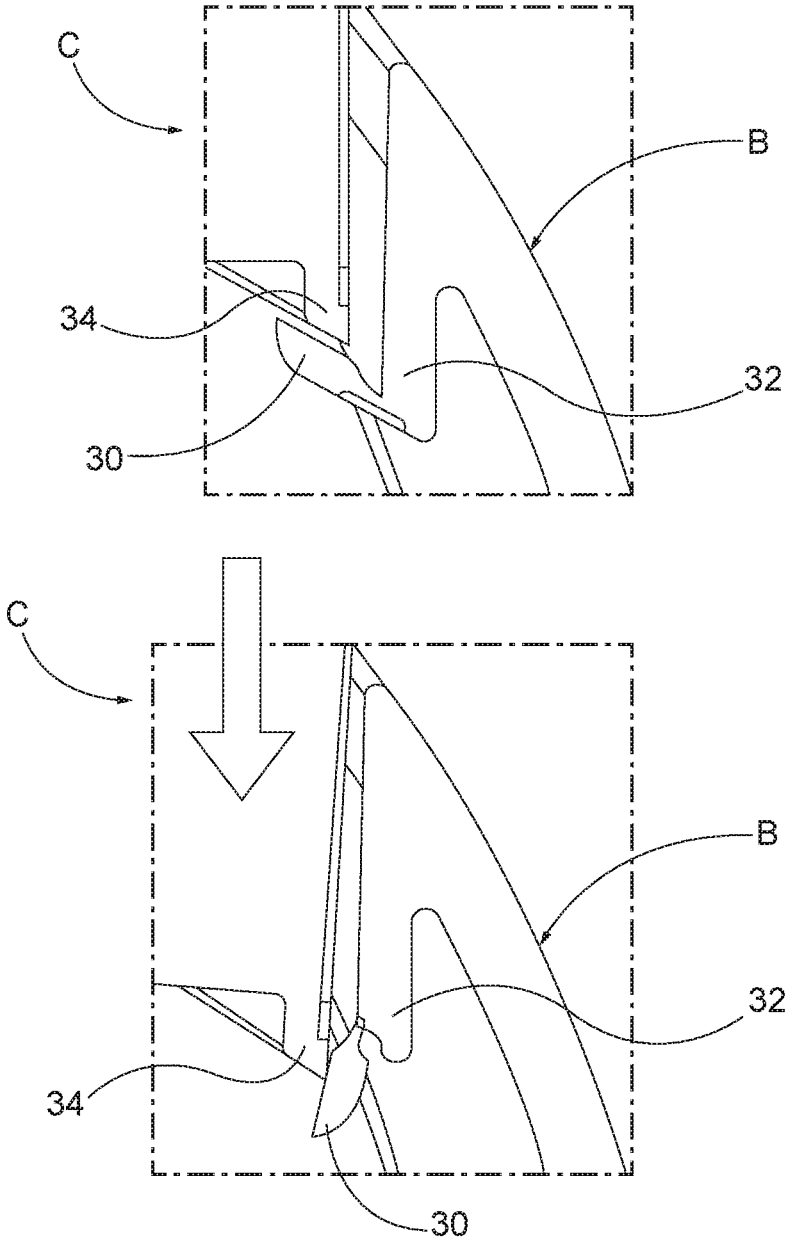
FIG. 9 is a cross-sectional view of the portion of the shroud to which the tab is connected, showing the position of the tab before and after the initial depression of the actuation member.

Referring now to FIGS. 5 and 9, a tab 30 is provided in order to stabilize the actuation member such that the actuation member is in the correct position to receive the valve stem into the stem bore pocket as the actuator is mounted on the container, further enhancing the ability of the actuators of the present invention to be mounted on containers as high speed.

Tab 30 extends from the shroud wall toward the actuation member. The tab is movable between an active position, where the actuation member is immobilized as the actuator is mounted on a container, and a passive position, where the tab allows the actuation member to move freely within the shroud.

One end of tab 30 is connected to the shroud by a "living hinge" which allows the tab to be rotated from its active position to its passive position The rotation of the tab occurs after the actuator is mounted on the container, upon the initial depression of the actuation member by the user. In its active position, the tab is in the path of movement of the actuation member, preventing the actuation member from moving relative to the shroud. In its passive position, the tab is situated outside the path of movement of the actuation member and no longer restricts or interferes with the movement of the actuation member.

As best seen in FIG. 9, the shroud B has an internal part 32 extending vertically downward from the interior surface of the shroud at a location spaced a short distance from the rear of the shroud. FIG. 5 shows the tab in its active position. Tab 30 extends from the bottom end of part 32.

The actuation member has a part 34 extending downwardly from the rear thereof. The end of part 34 has an inclined surface. In its active position, tab 30 is situated under part 34, maintaining the actuation member in the correct position for the stem bore pocket to receive the valve stem, as the actuator is mounted on the container.

The product is shipped with the tab in the active position. The tab remains in that position until the actuation member is depressed the first time by the user. As illustrated in FIG. 9, the initial depression of the actuation member will cause the actuation member part 34 move downwardly to rotate tab 30 from its active position to its passive position out of the path of movement of the actuation member such that the depression of the actuation member is no longer inhibited by the tab. Tab 30 will remain in its passive position throughout the life of the product, without interfering with the operation of the actuator.

The ribs of the stem bore pocket and the stabilization tab each contribute to the ability to mount the actuators of the present invention to containers in a high-speed manner. The tab stabilizes the position of the actuation member within the shroud. The ribs funnel the valve stems into the entrance of the stem bore pocket, correcting any misalignment between the valve stem and the entrance to the pocket.

During packaging and handling of the container with the aerosol actuator, a top load resulting from an external downward force may cause the actuation member to be depressed enough to accidentally release of the container contents, an unwanted occurrence. This may happen, for example, if the products are stacked one on top of another in a carton without packaging materials situated between the products.

Figure 2:
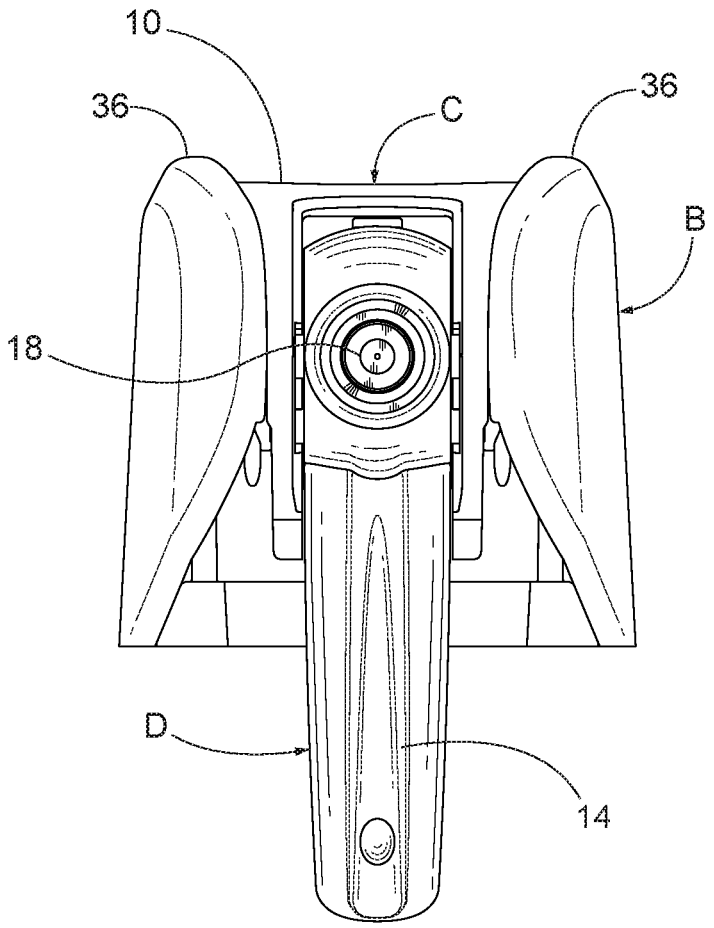
FIG. 2 is an elevation view of the front of the actuator.
Figure 3:
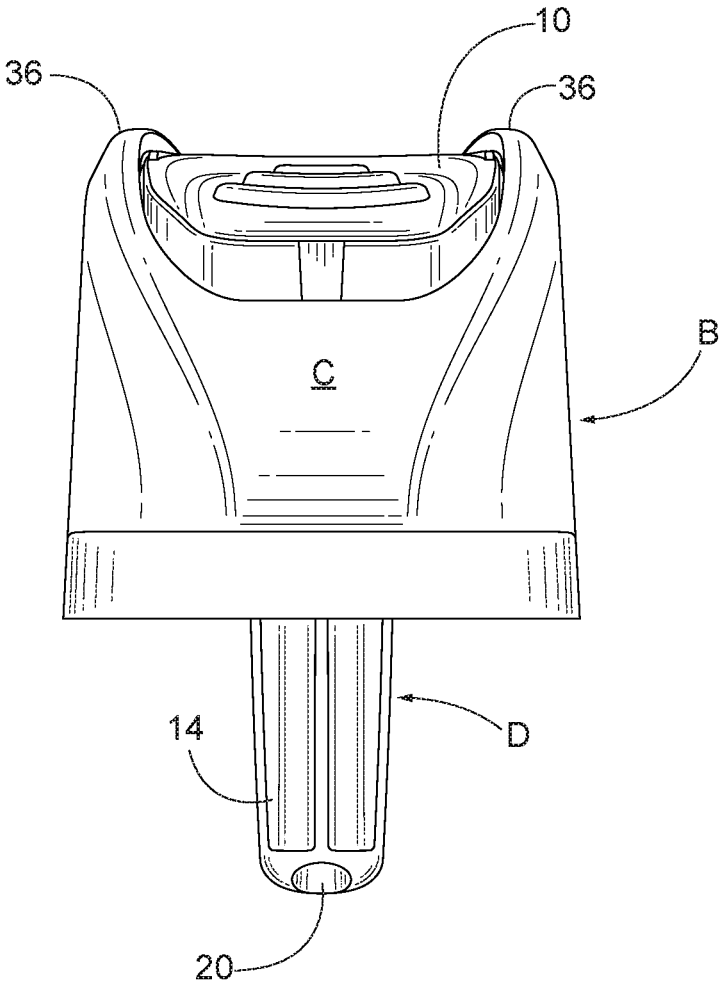
FIG. 3 is an elevation view of the back of the actuator.
Figure 4:
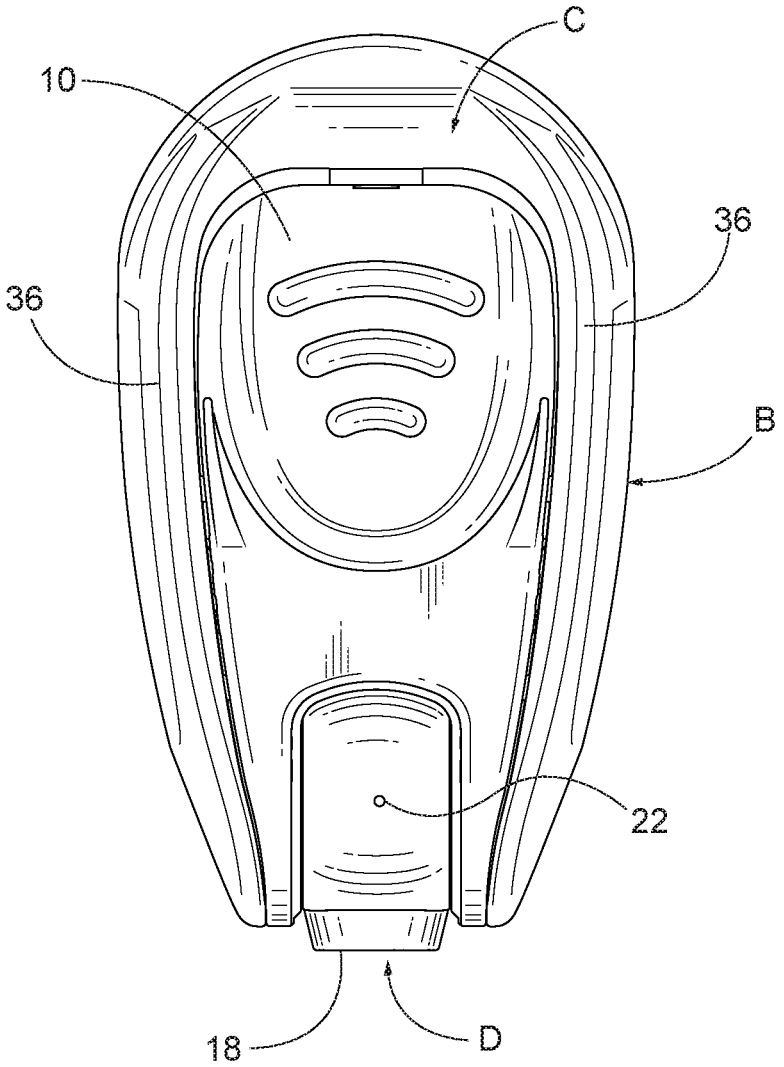
FIG. 4 is a plan view of the top of the actuator.

In order to avoid such accidental discharge from a top load, the present invention is designed such that the top edge 36 of the shroud was is extended above the plane of the button surface 10 of the actuation member. This is best seen in FIGS. 2 and 3. The extended top 36 of the shroud wall prevents a top load from a planar object from exerting an external force on the actuator. The extended shroud wall transfers the top load to the container. This structure accomplishes this function without restricting access to button surface 10 by the user and without requiring additional packaging materials.

It will now be appreciated that the present invention relates to an aerosol actuator which can be mounted to an aerosol container in high speed production by stabilizing the position of the actuation member and correcting any misalignment between the actuation member stem bore pocket and the valve stem. Further, the shroud wall is extended to avoid accidental release of the container contents resulting from a top load without restricting access to the actuation member or the necessity of additional packing materials.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

We claim:

1. An aerosol actuator for use with a container of pressurized fluid of the type having a valve with a stem depressible to release the contents of the container, said actuator comprising a shroud adapted to be situated on the container over the stern, an actuation member situated within said shroud comprising a stem bore pocket adapted to receive the valve stem, said actuation member being movable relative to said shroud between a first position wherein the valve stem is not depressed and a second position wherein the valve stem is depressed to release the contents of the container, said actuation member including a nozzle with an outlet port and a channel connecting the valve stem and said nozzle, said stem bore pocket having an axis parallel to an interior surface of the stem bore pocket, and a plurality of ribs extending from said interior surface of said stem bore pocket along the direction of said axis to facilitate entrance of the stern into said stern bore pocket, wherein said ribs comprise inclined surfaces proximate the entrance of said stem bore pocket, are circumferentially arranged around said interior surface of said stem bore pocket, are formed of compressible or resilient material, have tapered outer edges and function to funnel the valve stem into said stem bore pocket, the ribs guide the end of the valve stem into the stem bore pocket by aligning the stem bore pocket with the valve stem as the actuator is mounted on the container.

2. An aerosol actuator for use with a container of pressurized fluid of the type having a valve with a stem depressible to release the contents of the container, said actuator comprising a shroud adapted to be situated on the container over the stem, an actuation member mounted to said shroud for movement between a first position wherein the valve stem is not depressed and a second position wherein the valve stem is depressed to release the contents of the container, said actuation member including a nozzle with an outlet port and a channel connecting said valve stem and said nozzle, and a tab extending from said shroud toward the path of movement of said actuation member, said tab being moved from an active position intersecting said path of movement of said actuation member to a passive position remote from the path of movement of said actuation member only the first time said actuation member is moved from said first position to said second position, wherein said tab thereafter permanently remains in said passive position remote from the path of movement of said actuation member, wherein said actuation member comprises a stem bore pocket and said tab, in said active position stabilizes said actuation member such that said stem bore pocket is aligned with the valve stem.

3. The actuator of claim 2, wherein said tab, in its active position, maintains said actuation member in position to receive the valve stem during assembly of the actuator and the container.

4. The actuator of claim 2, wherein said actuation member is adapted to pivot said tab out of the path of movement of said actuation member as the actuation member is depressed for the first time.

5. The actuator of claim 2, wherein said actuation member is adapted to pivot said tab out of the path of movement of said actuation member as the actuation member is depressed for the first time by the user.

6. The actuator of claim 2, wherein said tab is connected to said shroud by a living hinge.

7. The actuator of claim 2, wherein said actuation member comprises a downwardly extending part configured to engage said tab as the actuation member is depressed for the first time.

8. The actuator of claim 7, wherein said part comprises an inclined surface.

* * * * *